United States Patent [19]

Holliday

[11] Patent Number: 4,850,950

[45] Date of Patent: Jul. 25, 1989

[54] ADJUSTABLE MOUNTING FOR EMBOSSING DIE ELEMENTS

[75] Inventor: George L. Holliday, Guilford County, N.C.

[73] Assignee: Ameritek Lasercut Dies, Inc., Greensboro, N.C.

[21] Appl. No.: 113,482

[22] Filed: Oct. 28, 1987

[51] Int. Cl.[4] ..... B31B 1/25

[52] U.S. Cl. ..... 493/475; 493/59; 101/163

[58] Field of Search ..... 493/58, 59, 475; 101/3 SP, 18, 150, 163

[56] References Cited

U.S. PATENT DOCUMENTS 1,983,323 12/1934 Stokes ..... 493/58 X
4,541,828 9/1985 Polic ..... 493/475 X

*Primary Examiner*—Eugene R. Laroche
*Assistant Examiner*—Robert J. Pascal
*Attorney, Agent, or Firm*—Boris Haskell

[57] ABSTRACT

An adjustable mounting block assembly, particularly for embossing die elements used with cutting, scoring and/or punching dies, having a block adjustably mounted within a frame. The perimeter of the block is spaced from the frame, and adjustable opposed spacers extend between the block and the frame so as to adjust the position of the block within the frame.

16 Claims, 4 Drawing Sheets

FIG. 2
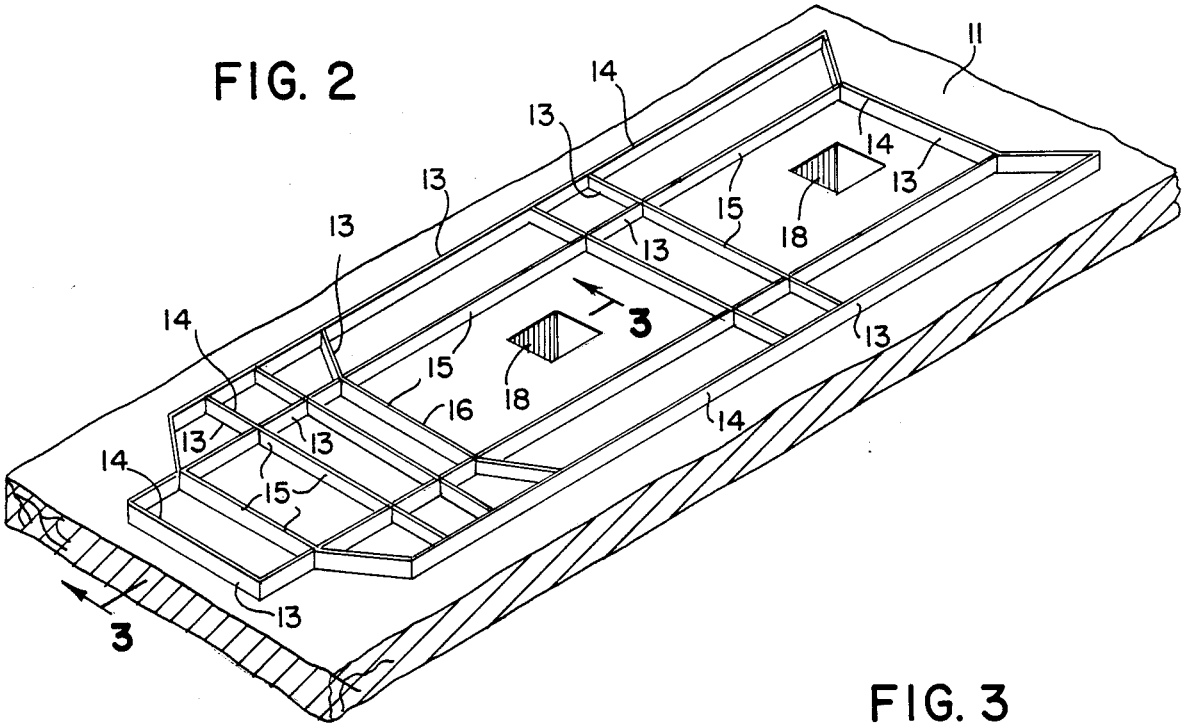
FIG. 3
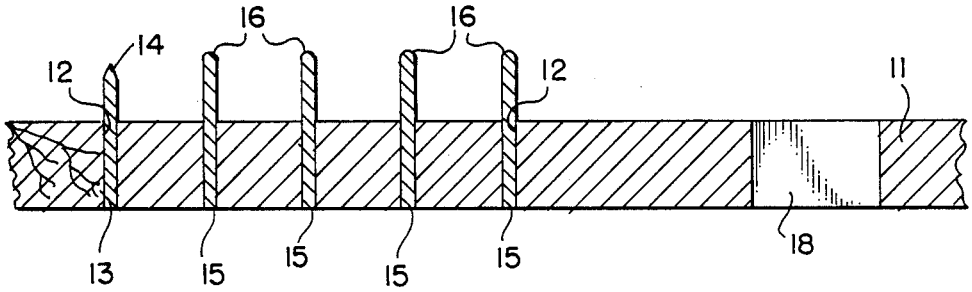
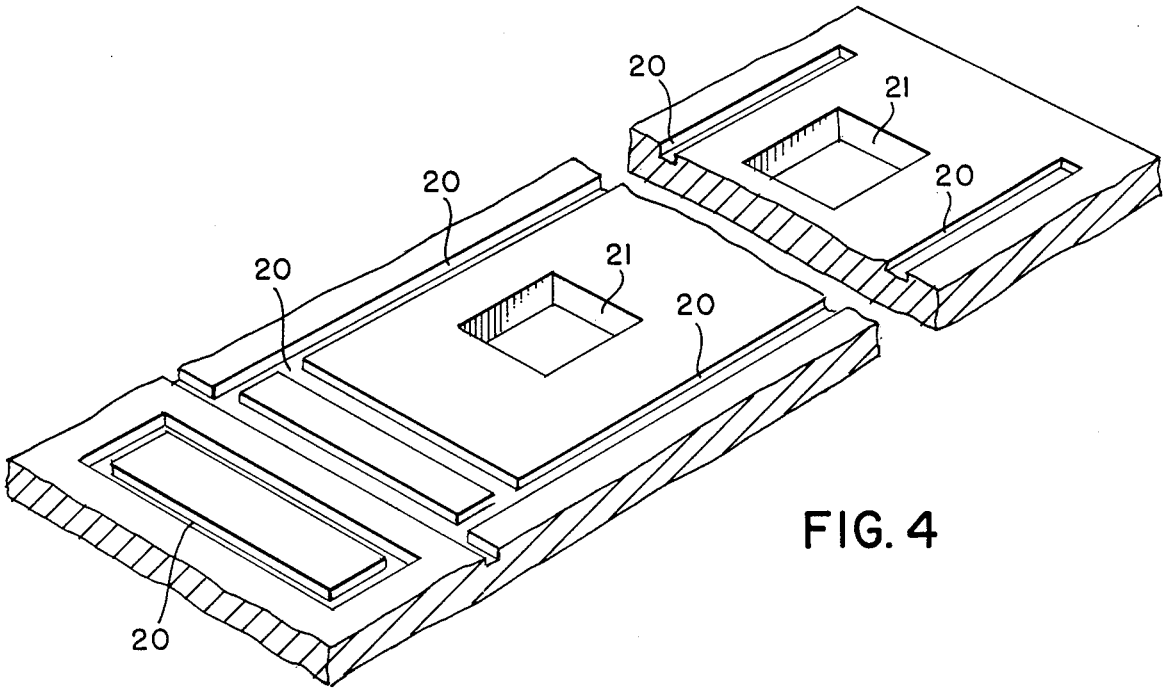
FIG. 4

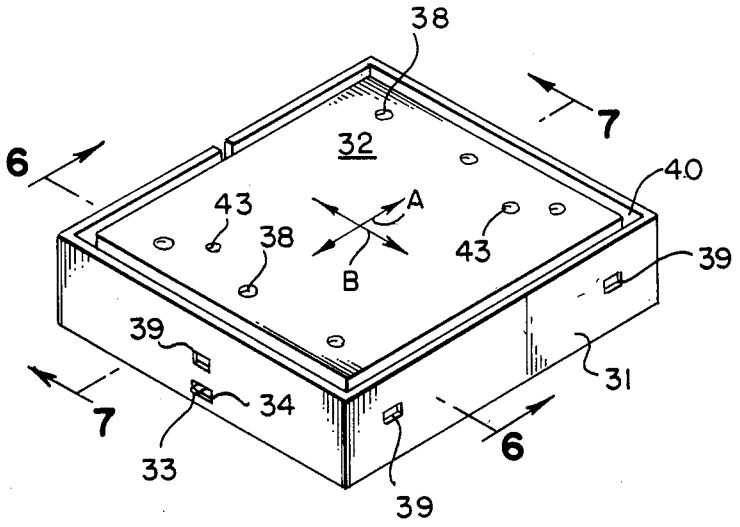
FIG. 5
FIG. 6
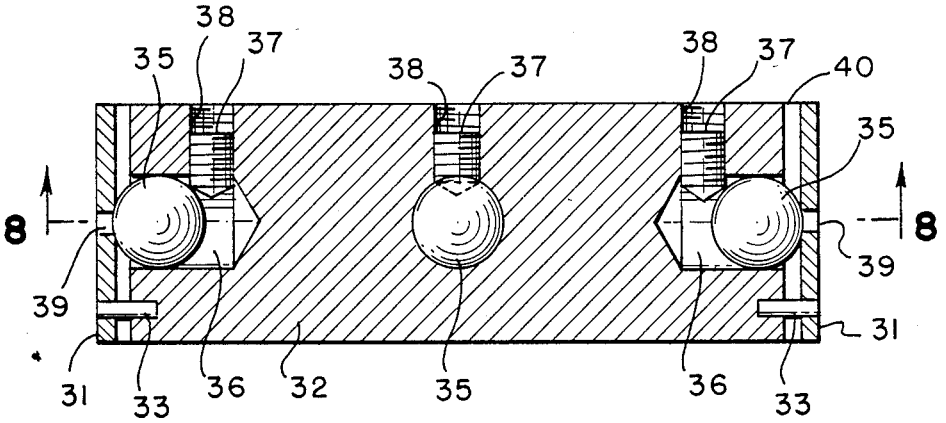
FIG. 7
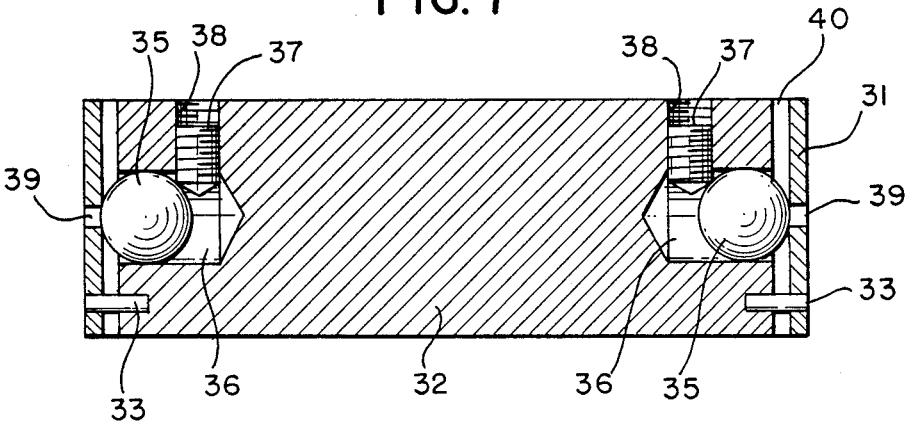

ADJUSTABLE MOUNTING FOR EMBOSSING DIE ELEMENTS

BRIEF SUMMARY AND BACKGROUND OF THE INVENTION

The present invention relates to the mounting of embossing die elements, and more particularly it relates to an adjustable mounting for the inclusion of embossing elements with cutting, scoring and punching dies. The invention is described herein with specific reference to rule dies, and the incorportion of embossing elements therewith. However, this is done for illustrative purposes only, and it will be apparent that the invention is not necessarily limited to use with such dies.

Rule dies are well known and widely used. Generally, a rule die comprises a plurality of cutting rules and a plurality of scoring rules, all mounted on a die board or plate in an appropriate configuration, and cooperating with a counterplate. The counterplate has surface grooves along lines that correspond to the scoring rules. The rule die and the counterplate are positioned in face to face relation in a reciprocating press adapted to bring them together, with the cutting edges of the cutting rules just kissing the surface of the counterplate, and with the edges of the scoring rules entering the counterplate surface grooves. Thus, when paper board stock is placed between the die and counterplate, it will be cut and scored in accordance with the rule pattern on the die. One of the more common uses of these rule dies is to stamp out paper board box blanks, intended to be folded along the formed score lines and glued to form a box.

It is commonplace in such paper board boxes to include an embossing. The embossing may be of any character, such as verbal, or a design, or an emblem. The normal way to accomplish the embossing is to include embossing die elements within the rule die plate or board and the counterplate, so that the embossing is accomplished simultaneously with the cutting and scoring. Embossing requires the presence of both an embossing die and a counter or mating intaglio, positioned respectively on the counterplate and the die board in face to face relation to come together in registry when the rule die and counterplate are brought together by the press. Since embossing is normally a decorative feature, it is important to obtain good quality embossing on the paper board. Therefore, near perfect registry of the embossing die and intaglio is required, and that registry must be maintained within close tolerances throughout the use of the die. The primary objective of the present invention is to facilitate that registry.

Because of its special character, an embossing intaglio is frequently mounted on a separate embossing block, which is in turn fitted into the rule die board, and the same is normally true of the corresponding embossing die carried on the counterplate. The primary purpose of the present invention is to provide a mounting structure for receiving the embossing die or its intaglio, which enables the precise alignment and registry of these devices after they are mounted in the die board and/or the counterplate, and enables their ready in situ readjustment as required to maintain registry during the extended use of the rule die.

In accordance with the present invention, the embossing element (either the embossing die or its intaglio) is affixed to a mounting block assembly that is mounted securely to the rule die plate or the counterplate, as the case may be. That may be done by press fitting the mounting block assembly into an aperture in the appropriate plate. The mounting block assembly of the invention comprises a circumambient perimeter frame that is press fitted into said aperture. The mounting block itself fits within the frame, but is smaller than the frame and is spaced on all sides from the frame. A plurality of adjustable spacers support and position the block within the frame. Each spacer extends an adjustable amount between the block and an adjacent portion of the frame, so that the block is rigidly supported in the frame by the spacers. Adjustment of the position of the block within the perimeter frame is accomplished by retracting and extending selected pairs of opposed spacers as required to obtain the precise positioning of the block, and of the die or intaglio mounted thereon, as desired. Obviously, after extended use, as the rule die and counterplate wear and shift slightly relative to each other, the registry of the embossing die and its intaglio must be adjusted, and this can be readily and quickly done, simply by readjusting the spacers to reposition the block, as required.

In the preferred embodiment of the invention hereinafter described in detail, the spacers are steel balls that project from close fitting cavities formed in the block to engage the surrounding frame. Adjustment of the projection of the steel balls is accomplished by camming screws threaded into tapped holes in the block. Those holes and the screws intersect the aforesaid cavities, and each screw bears on the respective steel ball at a point behind its crown. Thus, as a camming screw is threaded into its hole and engages a steel ball in its cavity, the ball is cammed and forced outwardly of the cavity to engage the surrounding frame.

It is accordingly one object of the present invention to provide for the adjustable mounting of an embossing die or its intaglio.

Another object of the present invention is to provide for the adjustable mounting of an embossing die or its intaglio as part of a cutting, scoring and/or punching die, or as part of a counterplate therefor.

Still another object of the present invention is to provide for the adjustable mounting of an embossing die or its intaglio as part of a rule die, or as apart of a counterplate therefor.

Other objects of the present invention will become apparent to those skilled in the art from a consideration of the ensuing further description of the present invention.

BRIEF DESCRIPTION OF THE DRAWINGS

The present invention is illustrated hereinafter by a detailed description of one specific and preferred embodiment, which is presented in conjunction with, and by reference to the accompanying drawings, in which like reference characters refer to like or corresponding parts, and wherein:

FIG. 2 is an isometric view of the die board of FIG. 1, with cutting and scoring rules inserted therein;

FIG. 3 is a cross section of FIG. 2, taken along line 3—3;

FIG. 4 is an isometric view of a portion of a counterplate for the die shown in FIG. 2;

FIG. 5 is an enlarged isometric view of a mounting block assembly embodying the present invention, and intended for carrying either an embossing die or its intaglio and for insertion in the counterplate and/or die board of FIGS. 4 and 2, respectively;

FIG. 6 is a cross section of FIG. 5 taken along line 6—6;

FIG. 7 is a cross section of FIG. 5 taken along line 7—7;

DETAILED DESCRIPTION

Figure 1:
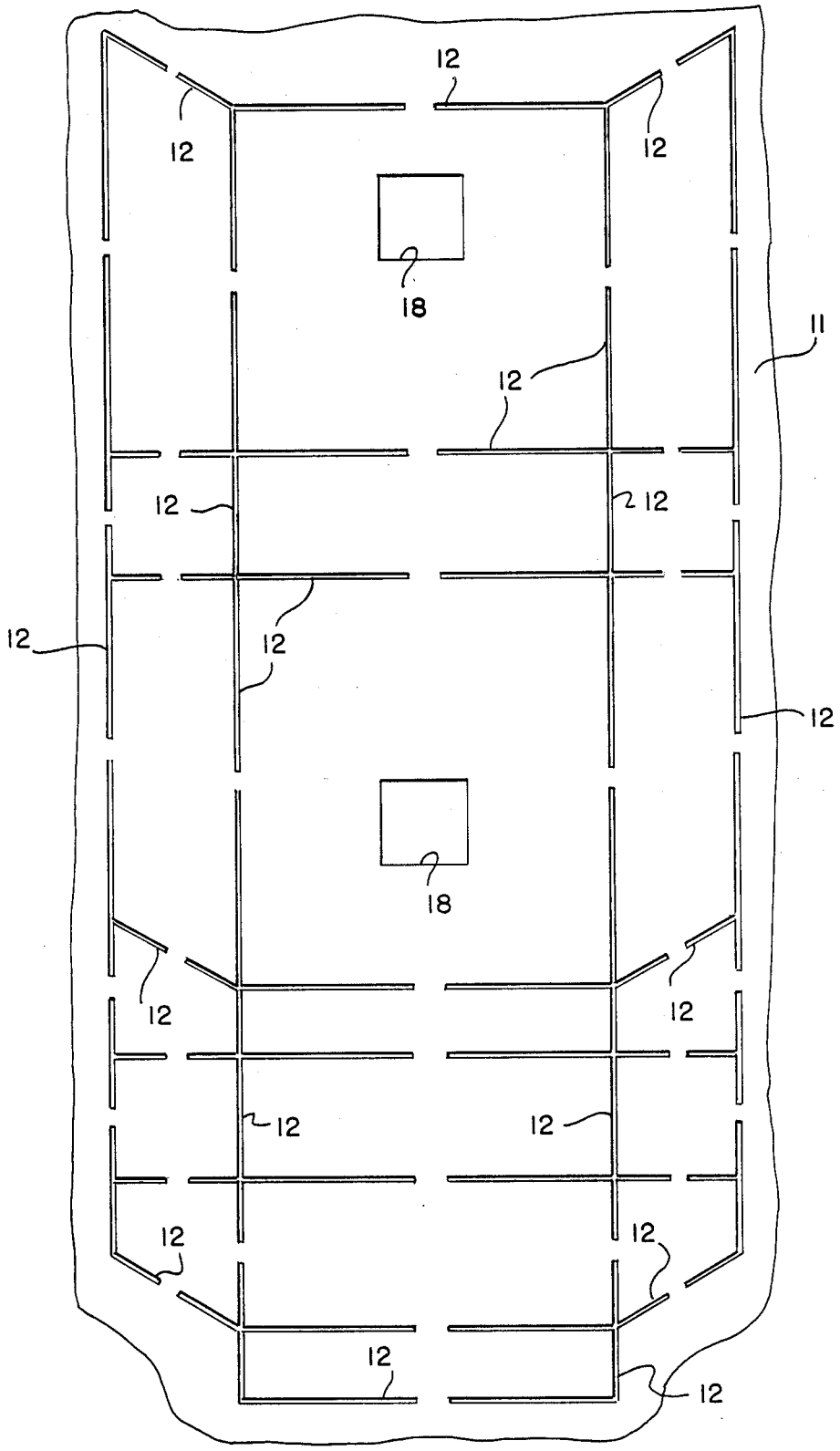
FIG. 1 is a face or plan view of a portion of a rule die board showing the cuts or slots formed therein to receive cutting and scoring steel rules, and apertures for receiving embossing die or intaglio mounting assemblies.
Figure 9:
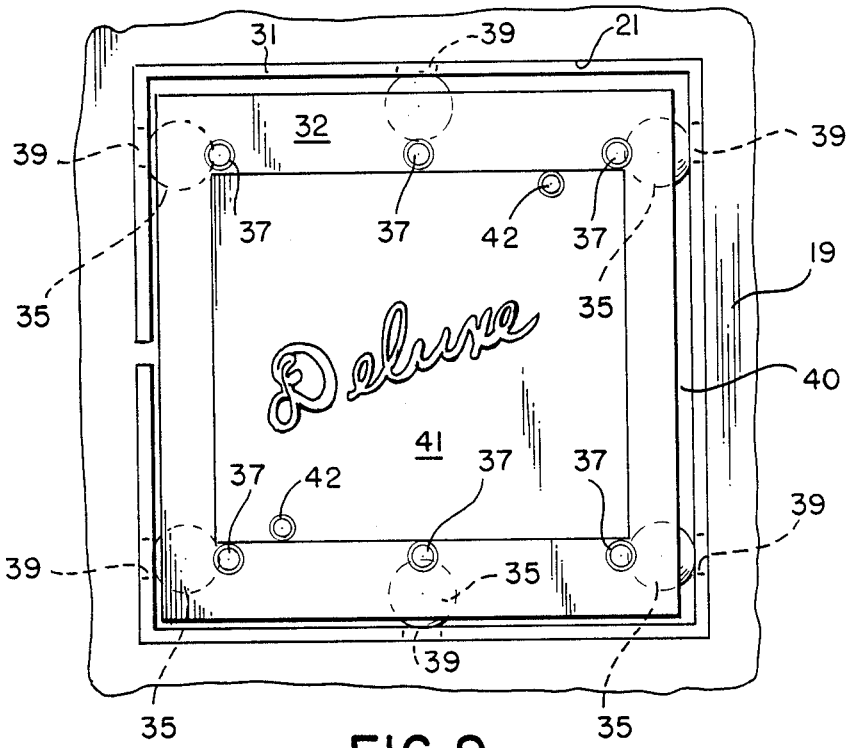
FIG. 9 is an enlarged top plan view of the mounting block assembly of FIG. 5 mounted in the counterplate of FIG. 4, having an embossing die affixed thereto, and shown in an adjusted position.
Figure 8:
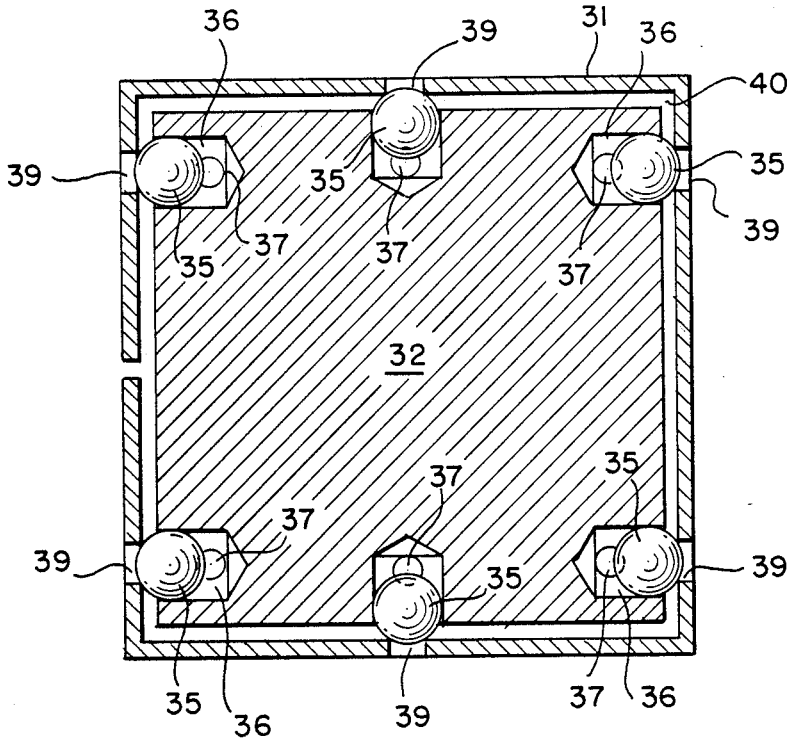
FIG. 8 is a cross section of FIG. 6 taken along line 8—8.

FIG. 1 is a fragmentary portion of a rule die board or plate 11, which is fabricated to be formed into a die to cut cigarette box blanks from paper board. The entire die board is normally a large device adapted to form many box blanks on each impression. The fragment in FIG. 1 shows a portion of the board adapted to form one of the box blanks. The pattern shown in FIG. 1 is repeated numerous times over the die board.

The die board of FIG. 1 and the die and counterplate illustrated in FIGS. 2–4 are essentially of conventional or well known construction, and will be described only briefly. The die board 11 is conventionally formed of wood or a composite material with an appropriate pattern of slots or cuts 12 formed through the board. These slots are sized in width and length to receive snugly appropriate cutting and scoring rules. The rules are shown inserted in FIGS. 2 and 3. The rules 13 are cutting rules and have sharp cutting edges 14; the rules 15 are scoring rules and have rounded non-cutting edges 16. The height of edges 16 of the scoring rules 15 above the surface of the board 11 is slightly greater than the height of the edges 14 of the cutting rules 13, as best shown in FIG. 3. The rules 13 and 15, when inserted in board 11, are forced to the bottom of the slots to provide consistency and uniformity for the projecting rules. In addition, the board 11 is formed with the rectangular apertures or cut outs 18, which are adapted to receive embossing intaglio mounting block assemblies to be described subsequently.

The counterplate 19 is shown in FIG. 4. It is preferably a steel plate, and is formed with grooves or recessed channels 20 in its face. The face of the counterplate is adapted to meet with the die cutting rules. The channels 20 are positioned to meet with and receive the rounded edges 16 of the scoring rules 15 when the operating press brings the ruled face of the die to the channelled face of the counterplate. The limit of movement of these two faces toward each other is established by operation of the press, so as to bring the knife edges 14 of the cutting rules to just kiss the surface of the counterplate 19, thereby effecting the appropriate cutting of the paper board therebetween. Since the edges 16 of the scoring rules 15 extend slightly farther than the knife edges 14, as best shown in FIG. 3, these edges enter into the grooves or channels 20, forming fold or score lines in the paper board. In addition, the counterplate 19 is formed with the rectangular apertures or cut outs 21, which are adapted to receive embossing die mounting block assemblies to be described subsequently. The locations of cut outs 21 in the counterplate correspond to cut outs 18 in the die board, so as to be juxtaposed when the die and counterplate are placed in operative facing relation.

The embossing mounting block assembly of the present invention, for insertion in rectangular apertures 18 and/or 21, is shown in enlarged illustrations in FIGS. 5-9. The mounting block assembly comprises a perimeter frame 31 formed into a rectangular shape from steel strap stock, or the like, containing therewithin a correspondingly shaped but smaller rectangular mounting block 32. The rectangular shape is simply the preferred shape of convenience, and as will be apparent, other regular and irregular shapes could be employed, such as octagonal, substantially circular, oval, trapezoidal, etc., if that were desired.

The perimeter frame 31 and block 32 are initially assembled and retained in assembled relation by a pair of pins 33 that are set in two opposite sides of the block 32, and project therefrom to engage in slots 34 of the frame 31.

The block 32 is shown with six cammed position-adjusting spacers in the form of ball bearings 35, although it will be apparent that more or less than six could be used, depending on size, shape and required rigidity of the mounting. Each ball 35 is housed within a bore 36 having a radius approximately equal to that of the spherical ball. A ball 35 once placed in its bore may be locked within the bore by peening one or two burrs at the mouth of the bore. For each bore 36, there is a camming screw 37 threaded into a respective hole 38 tapped into the block 32, so as to enter the bore essentially along a radius of the bore, and at a position along the axis of the bore that is behind the crown of the ball 35. The end of the screw 37 thus cams the ball 35 outwardly of the bore 36 as the screw is threaded into the hole 38 and enters the bore 36. This camming action is continued until the ball abuts the juxtaposed portion of the frame 31. In doing so, a small portion of the ball enters an elongate recess or seat in that portion of the frame, which for manufacturing convenience may be an elongate slot 39.

Thus, with all camming screws 37 retracted and the balls 35 floating freely in their respective bores 36, the block 32 is inserted and assembled to the frame 31 by inserting pins 33 through their elongate slots 34 and driving them into holes therefor in the block 32. An assembled mounting can now be press fitted and driven into the cut out receptacles 18 and/or 21 in the die plate 11 and counterplate 19, which are sized to receive the frame 31 of the mounting. The block 32 is freely movable back and forth within the frame 31 in two orthagonal directions, as indicated by the two double headed arrows A and B. The screws 37 are then threaded into their holes 38 to cam the balls 35 into firm engagement with the perimeter frame 31. An embossing die 41 is affixed to each block 32 in the counterplate 19 by screws 42 in tapped holes 43, and a corresponding intaglio (not shown) is similarly affixed to each block in the die board 11. The precise positioning of the blocks 32 and registry of each embossing die and its intaglio is accomplished by selectively loosening or retracting and tightening or advancing the camming screws for opposed pairs of balls 35. In doing so, the blocks 32 are shifted in a direction of arrows A or B by a desired amount within the limits afforded by the spacings 40 between the blocks 32 and their frames 31. Because the apertures 39 and 34 are all elongate, the balls 35 and pins 33 are able to ride in their apertures as required by the adjustment motion of the block 32.

In the final positioning of a block 32, the balls 35 are all cammed firmly against the frame 31 in their respective apertures 39. This locks up the mounting firmly in position in its plate, either the die plate or the counterplate. Further, it is apparent that if during the prolonged operation of the die system a registry adjustment of the embossing die or the intaglio becomes necessary, it is readily accomplished in the same manner as the initial positioning adjustment of the mounting block.

While the described adjustable mounting block assembly may be used in both the die board and the counterplate, it is apparent that adjustability of only one of the mating embossing die and intaglio is necessary. Where adjustability of only one is required, the other embossing element may be mounted on a fixed block sized to be press fitted into the apertures or cut outs 18 of the die board, or 21 of the counterplate.

In use, the die plate 11 with its cutting and scoring rules and embossing die is securely mounted on one plate of a reciprocating press, with the back side (unruled side) of the die board against the press plate. The counterplate is similarly securely mounted on the opposite plate of the press with its back side (unchannelled side) against the press plate. The die and counterplate are repetitively brought together and separated as the press plates are reciprocated, while paper board stock is fed therebetween, to cut, score and emboss the folding box blanks defined by the die.

The foregoing description of the preferred embodiment of the invention is presented as illustrative, only. It is obvious that the invention is not limited to that specific form or to any of the specific details shown and described. Since numerous variations and modifications will become apparent to those skilled in the art, such variations and modifications as are embraced by the spirit and scope of the appended claims are contemplated as coming within the purview of the invention.

What is claimed is:

1. An adjustable mounting block assembly comprising a block, a frame substantially surrounding said block and spaced from the perimeter of the block, at least one pair of adjustable spacers, each said spacer extending between said block and said frame, and means for adjustably extending each said spacer from said block to increase and decrease its extension, the extensions of the two spacers of said pair having relatively opposed directional components, whereby the position of said block in said frame is adjustable by increasing the extension of one of said two spacers and decreasing the extension of the other spacer.

2. An adjustable mounting block assembly as set forth in claim 1, having at least a second pair of adjustable spacers whose extensions have relatively opposed directional components in different directions than said directional components of said one pair of spacers.

3. An adjustable mounting block assembly as set forth in claim 2, wherein the opposed directional components of said one pair of spacers includes a directional component that is substantially perpendicular to a directional component of the opposed directional components of said second pair of spacers.

4. An adjustable mounting block assembly as set forth in claim 3, wherein each of said spacers is seated in a recess therefor formed in said frame, the recesses for said one pair of spacers being elongate in a direction substantially parallel to said opposed directional components of said second pair of spacers, and the recesses for said second pair of spacers being elongate in a directional parallel to said opposed direction components of said one pair of spacers.

5. An adjustable mounting block assembly as set forth in claim 4, wherein said block has a separate cavity therein for housing each spacer, and said adjustable extending means is a camming means associated with each said cavity.

6. An adjustable mounting block assembly as set forth in claim 5, wherein each said spacer is a bearing ball, and each said camming means is a screw threaded in said block to enter a respective cavity to cam said bearing ball outwardly from said cavity.

7. An adjustable mounting block assembly as set forth in claim 6, and further including at least two pins projecting from said block and entering respective elongate slots in said frame for retaining said block and frame in assembled relation.

8. An adjustable mounting block assembly as set forth in claim 1, wherein each of said spacers is seated in a recess therefor formed in said frame, each said recess being elongate in a direction transverse to said relatively opposed directional components.

9. An adjustable mounting block assembly as set forth in claim 8, wherein said transverse direction is a substantially perpendicular direction.

10. An adjustable mounting block assembly as set forth in claim 1, wherein said block has a separate cavity therefor housing each spacer, and said adjustable extending means is a camming means associated with each cavity.

11. An adjustable mounting block assembly as set forth in claim 10, wherein each said spacer is a bearing ball, and each said camming means is a screw threaded in said block to enter a respective cavity to cam said bearing ball outwardly from said cavity.

12. A cutting, scoring and embossing die, comprising cutting rules, scoring rules and a first embossing die element all mounted on a die board a counterplate therefor including a second embossing die element mounted thereon, at least one of said embossing die elements being an intaglio, at least one of said embossing die elements being affixed to an adjustable mounting block assembly on one of said die board and counterplate, said adjustable mounting block comprising a block carrying the embossing die element, a frame substantially surrounding said block and spaced from the perimeter of the block, at least one pair of adjustable spacers, each said spacer extending between said block and said frame, and means for adjustably extending each said spacer from said block to increase and decrease its extension, the extensions of the two spacers of said pair having relatively opposed directional components, whereby the position of said block in said frame is adjustable by increasing the extension of one of said two spacers and decreasing the extension of the other spacer.

13. A die as set forth in claim 12, said adjustable mounting block assembly having at least a second pair of adjustable spacers whose extensions have relatively opposed directional components in different directions than said directional components of said one pair of spacers.

14. A die as set forth in claim 13, wherein the opposed directional components of said one pair of spacers includes a directional component that is substantially perpendicular to a directional component of the opposed directional components of said second pair of spacers.

15. A die as set forth in claim 14, wherein each of said spacers is seated in a recess therefor formed in said frame, the recesses for said one pair of spacers being elongate in a direction substantially parallel to said opposed directional components of said second pair of spacers, and the recesses for said second pair of spacers being elongate in a direction parallel to said opposed directional components of said one pair of spacers.

16. An adjustable mounting block assembly comprising a block, a frame substantially surrounding said block and spaced from the perimeter of the block, at least one pair of adjustable spacers, each said spacer extending between said block and said frame, and means for adjusting each said spacer to increase and decrease its extension, the extensions of the two spacers of said pair having relatively opposed directional components, whereby the position of said block in said frame is adjustable by increasing the extension of one of said two spacers and decreasing the extension of the other spacer.

* * * * *